US005400731A

United States Patent [19]

Goldbeck et al.

[11] Patent Number: 5,400,731

[45] Date of Patent: Mar. 28, 1995

[54] METHOD AND SEWING SYSTEM FOR THE PRODUCTION OF A POCKET INSERT

[75] Inventors: Heinz Goldbeck; Dietrich Kahler, both of Bielefeld; Thorsten Vogt, Oerlinghausen, all of Germany

[73] Assignee: Dürkopp Adler Aktiengesellschaft, Bielefeld, Germany

[21] Appl. No.: 95,057

[22] Filed: Jul. 20, 1993

[30] Foreign Application Priority Data

Jul. 21, 1992 [DE] Germany ..... 42 23 966.4

[51] Int. Cl.[6] ..... D05B 3/10

[52] U.S. Cl. ..... 112/262.3; 112/68; 112/130

[58] Field of Search ..... 112/68, 65, 130, 129, 112/121.11, 262.3, 262.1

[56] References Cited

U.S. PATENT DOCUMENTS

| | | | |
|---|---|---|---|
| 3,820,481 | 6/1974 | Nicolay | 112/68 |
| 4,075,954 | 2/1978 | Hintzen et al. | 112/68 |
| 4,665,843 | 5/1987 | Goldbeck et al. | 112/68 |

*Primary Examiner*—Peter Nerbun

*Attorney, Agent, or Firm*—Ostrolenk, Faber, Gerb & Soffen

[57] ABSTRACT

A method and sewing apparatus including a twin-needle sewing machine (3) for making a pocket insert having a flap. The workpiece (47) is placed in a preparation station (50) and gripped by clamping plates (41, 42), then transported into a sewing position (51), and thereafter into a cutting position (52). Before the seams are made, measurement variables which provide information with respect to the angles formed by the flap-limiting edges are fed to a control (23). As a function of the measurement variables, a control (23) automatically sets the angles of the corner knives (69, 70) provided at the cutting position (51).

20 Claims, 5 Drawing Sheets

METHOD AND SEWING SYSTEM FOR THE PRODUCTION OF A POCKET INSERT

FIELD OF THE INVENTION

The present invention relates to a method and a sewing system for the production of a pocket insert.

BACKGROUND ART

U.S. Pat. No. 3,820,481 discloses a sewing system for the production of pocket inserts, which also permits the working of parts of sewing material in the form of flaps or strips. The quality of such pocket inserts is dependent to a large extent on how the length and shape of such sewing-material parts and pocket insert are adapted to each other.

In order to obtain exact agreement of the lengths of the workpieces, the sewing system is provided with a sensor device which detects the leading and trailing edges of the sewing-material part via a photocell in order to enable a control device to guide the formation of the seams and to cut properly. For this purpose, the control device automatically positions the corner knives in order to make the corner cuts in a manner corresponding to the detected length of the sewing-material part. With respect to the shape of the sewing-material part, a manual entry must be made into the control device, which accordingly controls the functions involved in producing a seam, making the middle cut, and angularly positioning the corner knives which make the corner cuts.

Because of the requirement that there be a manual entry with respect to the shape of the pocket insert to be produced, erroneous entries into the control can impair the quality or even cause rejection of the finished product.

Another difficulty is caused by manufacturing tolerances with respect to the angles with which the sewing-material parts to be sewed together are prepared. As a result, it is frequently necessary for an entry to be corrected. Furthermore, different shapes cannot be worked in rapid sequence.

In view of the necessary inputs, and possibly their correction, as well as verification and monitoring tasks, there is additional work for the operator, as a result of which, in the final analysis, the quality of the product and the output of the sewing system are impaired.

All prior art materials mentioned herein are expressly incorporated by reference.

SUMMARY OF THE INVENTION

Therefore, the main object of the invention is to develop a method and a sewing system which have automatic adjustment of the angles of the corner knives performing the corner cuts.

This object and other objects are achieved by a method comprising the steps disclosed and claimed herein. Before making the corner cuts, at least one of the edges of the second sewing-material part, such as a pocket flap, is detected by a sensor device which is connected with the control unit of the sewing system. Then, after detection of the edge the sensor device gives off a measurement value to the control unit. The angle of the second sewing-material part is determined by means of the measurement value. A setting member for the corner knife corresponding to the detected edge of the second sewing-material part receives from the control unit a signal to turn the corner knife until the end points of the corner cut define a line which extends parallel to a line defined by the limiting points of the seams.

The foregoing method steps eliminate the time-consuming adjustment work, verification and monitoring tasks and adjustment corrections which are necessitated by increasingly smaller size lots with continuously changing angle dimensions. The automatic angle adjustment of the corner knives furthermore makes it possible to compensate for inaccuracies in the manufacture of previously formed sewing-material parts.

Preferably, two measurement points which detect the edge are defined which are at unequal distances from the axis of the workpiece. This leads to an additional saving in time, in that the operating step of detection of the angle of the sewing-material part to be worked takes place partially overlapping in time the process of the production of the pocket insert.

In an alternative embodiment, the edge of the second sewing-material part can be detected by a detection device such as a camera, and the measurement variable can be given off to the control unit in the form of information representing the angle of the detected edge. In this embodiment, edge detection is independent of the transport of the sewing-material part and can take place at a standstill in the preparation station, which permits a direct and rapid detection and receipt of information with respect to the angles detected.

According to another feature of the invention, the sensor device detects both edges of the second sewing-material part, and the angles of each edge of the second sewing-material part are determined by the control unit, each setting member being fed by the control unit with a signal for the displacement of the corresponding corner knife corresponding to the respective angle. In this form of the invention, both edges of the second sewing-material part are detected independently of each other and, accordingly, separate displacements are brought about on the corresponding corner knives so that manufacturing tolerances with respect to the angles of the two edges of the second sewing-material part are taken into account.

A sewing system for the carrying out of the method described above may comprise:

- a twin-needle sewing machine with a drive for producing seams extending parallel to an axis (A) in a first sewing-material part, a piece of material positioned thereon, and a second sewing-material part which is positioned thereon and which has a first edge and a second edge extending, in each case, at an angle (W1, W2) to the axis (A),
- a transport device with a drive for the sewing-material parts,
- a knife which produces a longitudinal cut between the seams,
- a cutting device, including a drive and corner knives for producing corner cuts at least in the first sewing-material part, and
- a control unit for the drives of the twin-needle sewing machine, the transport device, and the cutting device, and for the production of the corner cuts with variable angle positions, the corner cuts having end points (P, Q, R, S),
- a sensor device for detecting at least one of the edges of the second sewing-material part and providing a measurement value to the control unit, and the control unit having a control part which converts the measurement value into a signal for controlling the variable angle positions of the corner cuts.

The system described above makes possible an even more extensive adaptation of the manufacturing process to existing conditions, leading to increased quality of the product, to a reduction of cost as a result of the time saved and the reduction of rejects, and to more extensive relieving of the operator.

The system may have two devices for the detection of measurement points (T, V, U) of the edge of the second sewing-material part, the devices being arranged at unequal distances from the axis (A). This leads to a solution of favorable cost in which a path-detection or length-detection system which is already present is used at the same time to obtain information for the displacement of the corner knives.

The devices preferably have light barriers for detecting the measurement points (T, V, U, W) of the edges of the second sewing-material part. This feature leads to comfortable operation in which inaccuracies with regard to the exact positioning of the second sewing-material part are compensated for.

The sensor device may be developed as an angle-detection device such as a camera, which makes it possible to detect the edges of the second sewing-material part independently of relative movement between the sensor means and the second sewing-material part. This makes it possible to effect the edge detection, for instance, while the workpiece is in a feed device arranged in front of the sewing system.

Preferably the sensor device is capable of detection of the distance extending between the edges and parallel to the axis (A) of the workpiece. The sewing system with this feature permits automatic detection of the length of the sewing-material part which is to be sewn on, as a result of which length tolerances in the sewing-material parts to be worked can be compensated for and thus a maximum degree of improvement in operation is obtained.

BRIEF DESCRIPTION OF THE DRAWINGS

Further objects, features, and advantages of the invention will be understood from the following description read with reference to the drawing in which embodiments of the sewing system and method are shown.

In the drawings.

DETAILED DESCRIPTION OF EMBODIMENTS OF THE INVENTION

Embodiment 1

Figure 1:
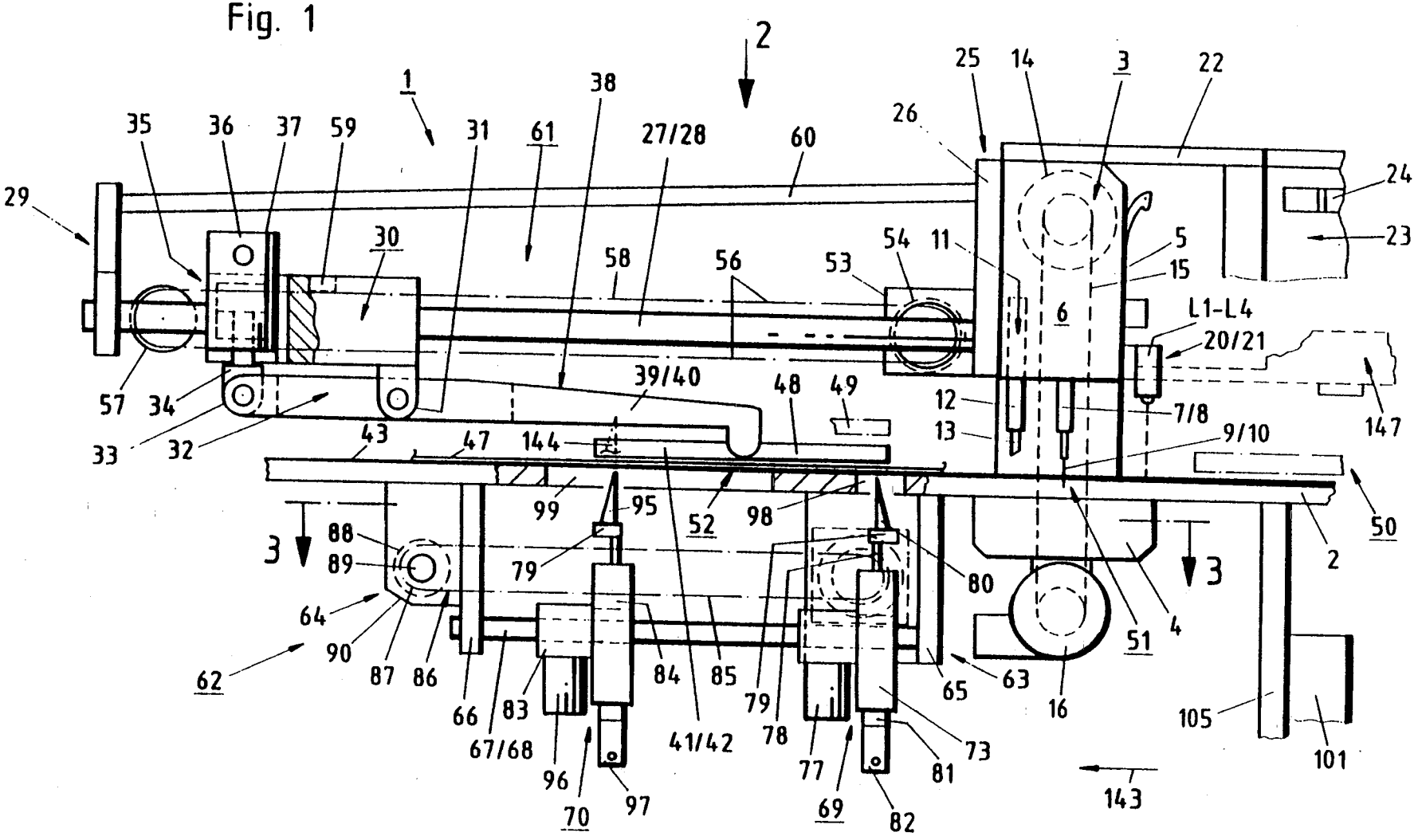
FIG. 1 is a front view of a sewing system.
Figure 2:
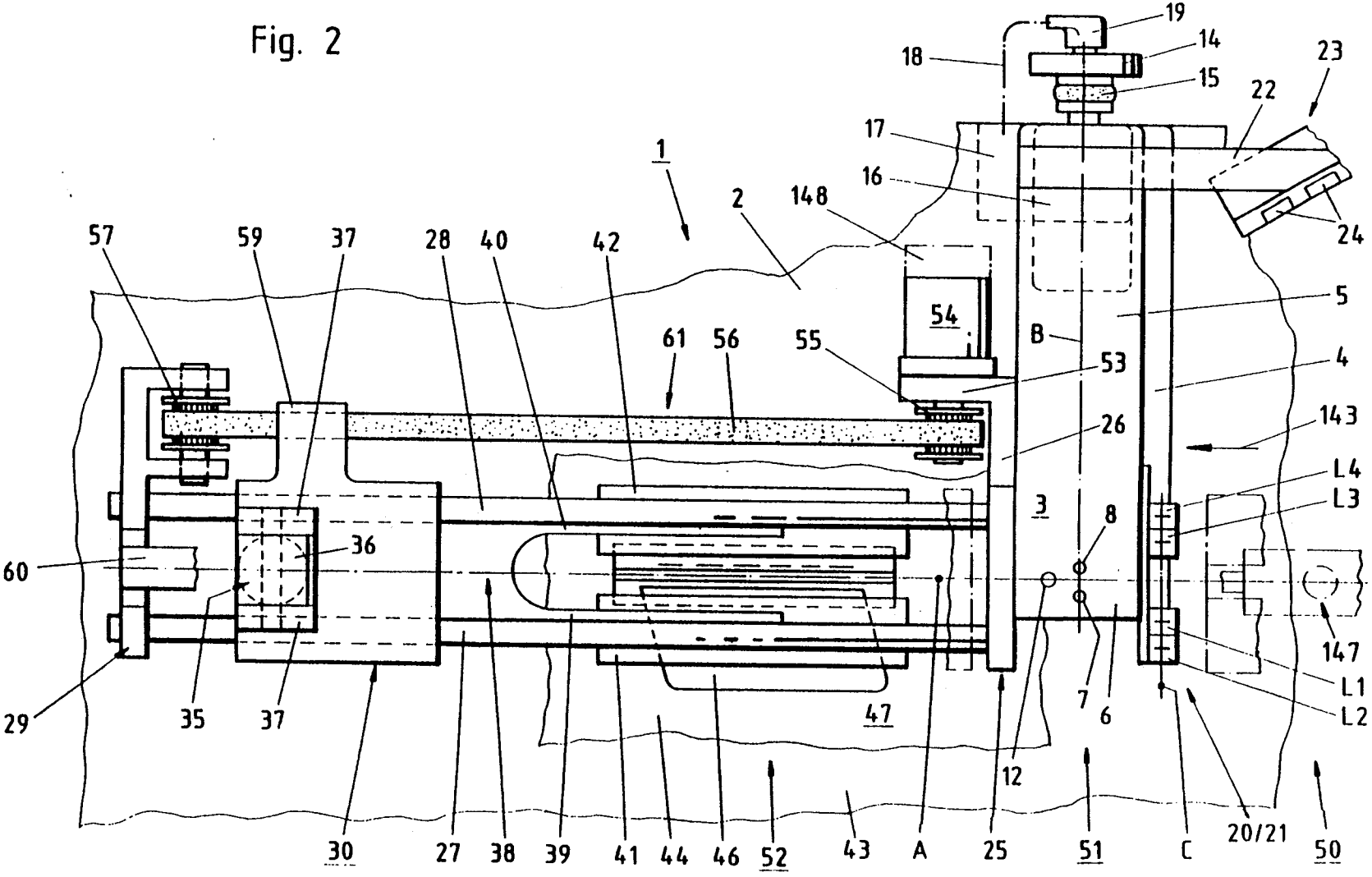
FIG. 2 is a plan view of the sewing system taken in the direction indicated by the arrow 2 in FIG. 1.
Figure 3:
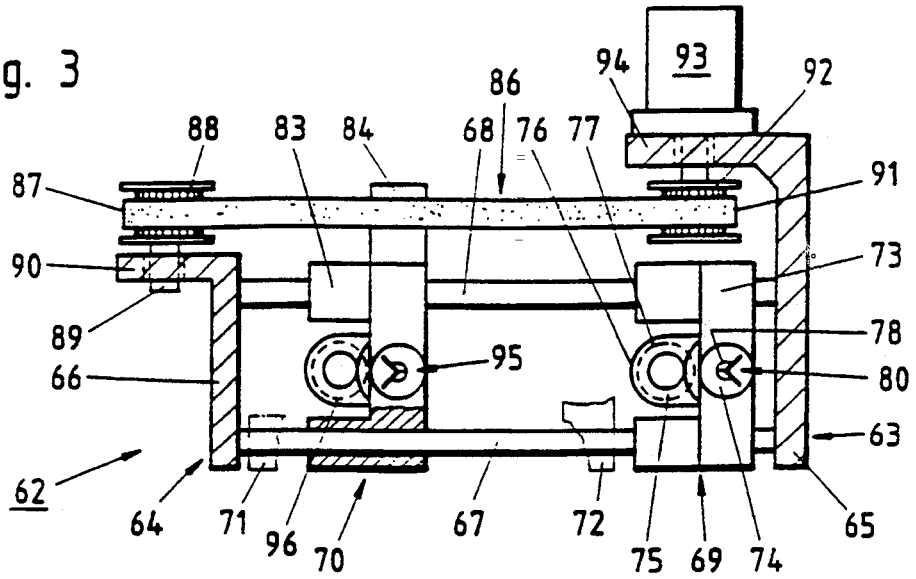
FIG. 3 is a sectional plan view of a cutting system seen in the direction indicated by the arrow 3—3 in FIG. 1.
Figure 7:
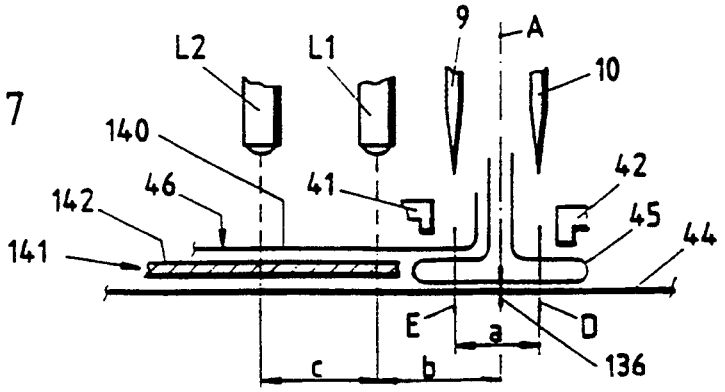
FIG. 7 is a view of the sewing-material parts shown in FIG. 6, seen in the direction indicated by the arrow 7 in FIG. 6.

Referring first to FIGS. 1–3, the sewing system 1 is developed with a work plate 2 within which the baseplate 4 of a twin-needle sewing machine 3 is contained. The twin-needle sewing machine 3 is developed with an arm 5 in the customary manner, the arm extending parallel to the baseplate 4 and terminating in a head 6. Within the head 6 there is arranged a crank drive (not shown) for the driving of two needle bars 7, 8 which can be engaged and disengaged independently of each other and in each of which a needle 9, 10 is fastened. The needles 9 and 10 are at a distance a from each other (FIG. 7) and cooperate with shuttles or loopers (not shown) which are rotatably mounted in the baseplate 4, including thread cutting devices.

Furthermore, within the head 6 there is provided a cutting device 11 which has an upward and downward moving bar 12 bearing a knife 13. The knife 13 is arranged centrally with respect to the distance apart a of the needles 9, 10 and cooperates with a mating knife (not shown) arranged in the baseplate 4. The cutting device 11 is developed so that it can be engaged and disengaged, the bar 12 with the knife 13 being movable into a position of rest located above the mating knife or into a working position. In the working position, the bar 12 is movable up and down, the knife 13 being in engagement with the mating knife.

The twin-needle sewing machine 3 is furthermore provided with a handwheel 14 which is connected via a belt drive 15, to a drive motor 16. The latter is combined with a motor control 17 (FIG. 2) to form a unit which is fastened on the baseplate 4. The motor control 17 is connected by a cable 18 to a rotary-position transmitter 19 fastened on the hand wheel 14. The drive motor 16, in combination with the motor control 17 and the rotary-position transmitter 19 connected by the cable 18, form a known type of sewing machine drive which makes it possible to drive the twin-needle sewing machine 3 in defined fashion, stop it, and by means of additional integrated functions, control the cutting of the thread, the engagement and disengagement of the two needle bars 7, 8, and the engagement and disengagement of the cutting device 11.

In accordance with FIG. 2, parallel to the work plate 2 and centrally between the needles 9, 10 there extends an axis A, perpendicular to which there is an axis B passing centrally through the needles 9, 10. At the end of the head 6 facing the work plate 2, there is arranged a sensor device 20 which has light barriers L1, L2, L3 and L4. (A simplified sensor device 21 could comprise merely the light barriers L1 and L2.) As can be noted from FIGS. 2 and 6, the light barriers L1 to L4 are arranged on an axis C which extends parallel to and at a distance d from the axis B. The light barrier L1 is arranged at a distance b from the axis A and the light barrier L2 at a distance c from the light barrier L1. The light barriers L3 and L4 are arranged in a manner corresponding to the light barriers L1 and L2, i.e. symmetrically to the axis A.

In the region of the handwheel 14 a support arm 22 is fastened to the arm 5. A control 23 with operating elements 24 is arranged on the free end of the support arm 22.

Opposite the light barriers L1 to L4, a bracket or angular support 25 is arranged on the arm 5, one arm 26 of the bracket 25 being screwed firmly to the head 6 of the twin-needle sewing machine 3. On the arm 26 are fastened two guide bars 27 and 28 which extend parallel to each other and parallel to the axis A and above the work plate 2. The guide bars 27 and 28 end in a bearing member 29 in which they are firmly received. On the guide bars 27 and 28 is displaceably mounted, without play, a carriage 30 which can thus be moved back and forth parallel to the axis A above the work plate 2. The carriage 30 has a bearing 31 on the side facing the work plate 2, in which a two-armed lever 32 is rotatably received. One end 33 of the lever 32 which extends along the axis A is fork-shaped and connected in articulated manner with a bar 34 of a pneumatic cylinder 35. A double-acting pneumatic cylinder 35 has an end 36 swingably contained within a bearing 37 on the carriage 30. The free arm 38 of the lever 32 is fork-shaped and is provided at its ends 39, 40 with clamping plates 41, 42.

The work plate 2 and the baseplate 4 of the twin-needle sewing machine 3 contained therein are covered by a metal sheet (not shown) of polished steel having a thickness of 0.5 mm, which forms a top side 43 of the work plate 2. On the top side 43 is displaceably received a first sewing-material part 44. On the first part 44 there rests a piece of material 45, which is developed here as a piping strip and will be referred to below as piping strip 45. Furthermore, a second sewing-material part 46 (for example a pocket flap) is placed on one side of the piping strip 45. The sewing-material parts 44, 46 and the piping strip 45 together form a workpiece 47.

According to FIGS. 1 and 2, the sewing-material parts 44, 46 and the piping strip 45 are located between the top side 43 and the clamping plate 41, and the sewing-material part 44 with the piping strip 45 is located between the top side 43 and the clamping plate 42. In order to assure a dependable clamping connection between the workpiece 47 and the clamping plates 41 and 42, each of the latter has a friction covering (not shown) bonded to the side thereof facing the workpiece 47.

With the above-described arrangement of the lever 32 including the clamping plates 41 and 42 which are connected with it and the pneumatic cylinder 35 it is possible to bring the clamping plates 41, 42 into a clamping position 48 near the top side 43 and into a free position 49 which is remote from the top side 43. It is furthermore possible to move the clamping plates 41, 42 along the axis A by displacing the carriage 30 on the guide bars 27 and 28, from a preparation station 50 via a sewing position 51 into a cutting position 52. In this connection, the sewing position 51 is defined by the needles 9, 10 of the twin-needle sewing machine 3.

On a free arm 53 of the bracket 25 (FIG. 2) there is fastened a drive motor 54 having a toothed belt wheel 55 which receives one end of a toothed belt 56. The free end of the toothed belt 56 is taken up by a toothed-belt pulley 57 which is mounted rotatably on a fork-shaped part (without number) of the bearing member 29. The toothed belt 56 is firmly connected at a point within its upper course 58 to a web 59 which is part of the carriage 30. Furthermore, the bearing member 29 is connected to the arm 26 of the bracket 25 via a connecting rod 60. The structural parts described above, including the carriage 30 which is displaceably mounted on the guide bars 27 and 28, the lever 32 arranged thereon, including the clamping plates 41, 42, the drive motor 54 and the toothed belt 56 drivingly connected therewith, form a transport means 61.

The transport means 61 is designed with a predetermined diameter of the toothed-belt pulley 55 and a pulse-controlled drive motor 54 so as to provide a resolution, i.e. a distance per pulse, of preferably 0.1 millimeter.

Below the work plate 2, a corner cutting device 62 having two angle brackets 63 and 64 is fastened. The free ends of two guide bars 67, 68 arranged parallel to each other are fastened in the arms 65, 66 of the brackets 63, 64. The brackets 63, 64 are fastened to the work plate 2 in such a manner that the guide bars 67, 68 extend parallel to the top side 43 of the work plate and to the axis A. One corner knife 69 is fixed in place on the guide bars 67, 68. The other corner knife 70 is received displaceably without play on the guide bars 67, 68, and can assume the end positions 71, 72 indicated in dot-dash line in FIG. 3.

The corner knife 69 is generally known in its construction and manner of operation from German Patent 22 41 044 (corresponding to U.S. Pat. No. 3,820,481) so that the description below is limited to the essential parts and to those parts which are different in the present embodiments than in the prior art.

The corner knife 69 is developed with a housing 73 in which there is contained with play, on the one hand, the guide bars 67, 68 and, on the other hand, a bearing 74 which is swingable around an axis extending at right angles to the top side 43 of the work plate 2. The bearing 74 is developed with a toothed part (not shown in detail) into which a pinion (not shown in detail) engages, as indicated diagrammatically in FIG. 3. The toothed part and the pinion together form a toothed connection 75. The housing 73 is furthermore developed with a bearing lug 76 within which a servomotor 77, in this case a stepping motor, is fastened. Within the bearing 74 there are included, in accordance with the aforementioned prior art patent, a pair of bars 78 and limiting stops (not shown). The two individual bars of the pair of bars 78 are received so as to be longitudinally displaceable, independently of each other, in the bearing 74, and each is provided on its end 79 facing the work plate 2 with a wedge-shaped knife. The two knives form a knife pair, which is referred to below as the cutting knife 80. The bearing 74 is firmly connected at its free lower end 81 to a knife drive 82 which, as is known, has a single-acting pneumatic cylinder associated with the pair of bars 78.

The construction of the displaceable corner knife 70 corresponds to the corner knife 69 described above, except that its housing 83 is displaceably received on the guide rods 67 and 68, and that an extension 84 in the form of a support arm is provided on the housing 83, as seen in FIG. 3. The extension 84 is firmly attached to the lower course 85 (FIG. 1) of a toothed belt 86. One end 87 of the toothed belt 86 is received by a toothed-belt pulley 88 which is rotatably mounted via a shaft 89 on the free arm 90 of the bearing 64. The other end 91 of the toothed belt 86 is received by a toothed-belt pulley 92 which is firmly arranged on the shaft (not further designated) of a drive motor 93. The drive motor 93 is firmly screwed onto the free arm 94 of the bearing 63. The drive motor 93 is a stepping motor in the present embodiment and is connected with a corresponding control, as will be described further below.

Corresponding to the construction of the stationary corner knife 69, the displaceable corner knife 70 has a cutting knife 95 formed by a knife pair on the upper ends 79 of a corresponding pair of bars, which is developed in the same way as the cutting knife 80. Furthermore, a servomotor 96 is provided on the corner knife 70, its construction corresponding to that of the aforementioned servomotor 77. Finally, a knife drive 97 corresponding to the knife drive 82 is also provided on the corner knife 70.

As can be noted from FIG. 1, the work plate 2 is developed with a recess 98 for the unimpeded passage of the cutting knife 80 of the stationary corner knife 69 and with a recess 99 for the unimpeded passage of the cutting knife 95 of the displaceable corner knife 70. The recess 99 is shaped in accordance with the range of displacement of the displaceable corner knife 70. The sheet plate (not shown) resting on the work plate 2 and the baseplate 4 of the twin-needle sewing machine 3 has openings which correspond in their shape to the recesses 98 and 99.

Figure 4:
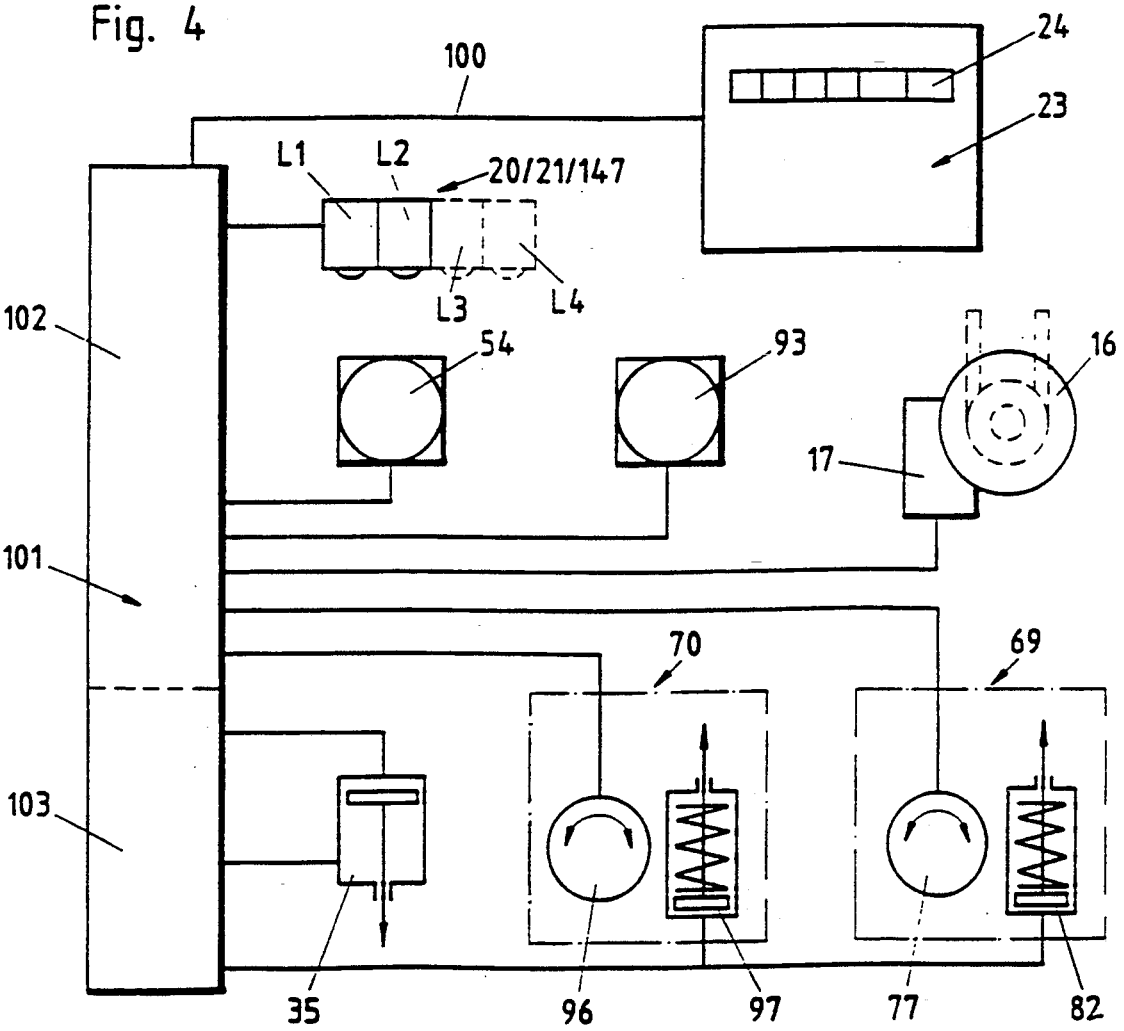
FIG. 4 is a block diagram of the control for the sewing system, including elements for the input of information and various setting elements.

As can be noted from the block diagram of FIG. 4, the control 23 is connected via a connecting cable 100 to a distributor box 101 which has an electrical unit 102 and a pneumatic unit 103. The electrical part 102 is connected via cables, not individually designated, for controlling the sensor device 20 (or 21), the drive motor 54 for the workpiece carriage, the drive motor 93 for the cutting device, the motor control 17 for the sewing machine, the servomotor 96 of the displaceable corner knife 70, and the servomotor 77 of the stationary corner knife 69. Furthermore, the pneumatic unit 103, which has a compressed air supply and pneumatic valves, is connected via hoses not shown in detail to the pneumatic cylinder 35 on the workpiece carriage, the knife drive 97 of the displaceable corner knife 70, and the knife drive 82 of the stationary corner knife 69. The distributor box 101 is fastened to the frame 105 which supports the work plate 2 (FIG. 1).

Figure 5:
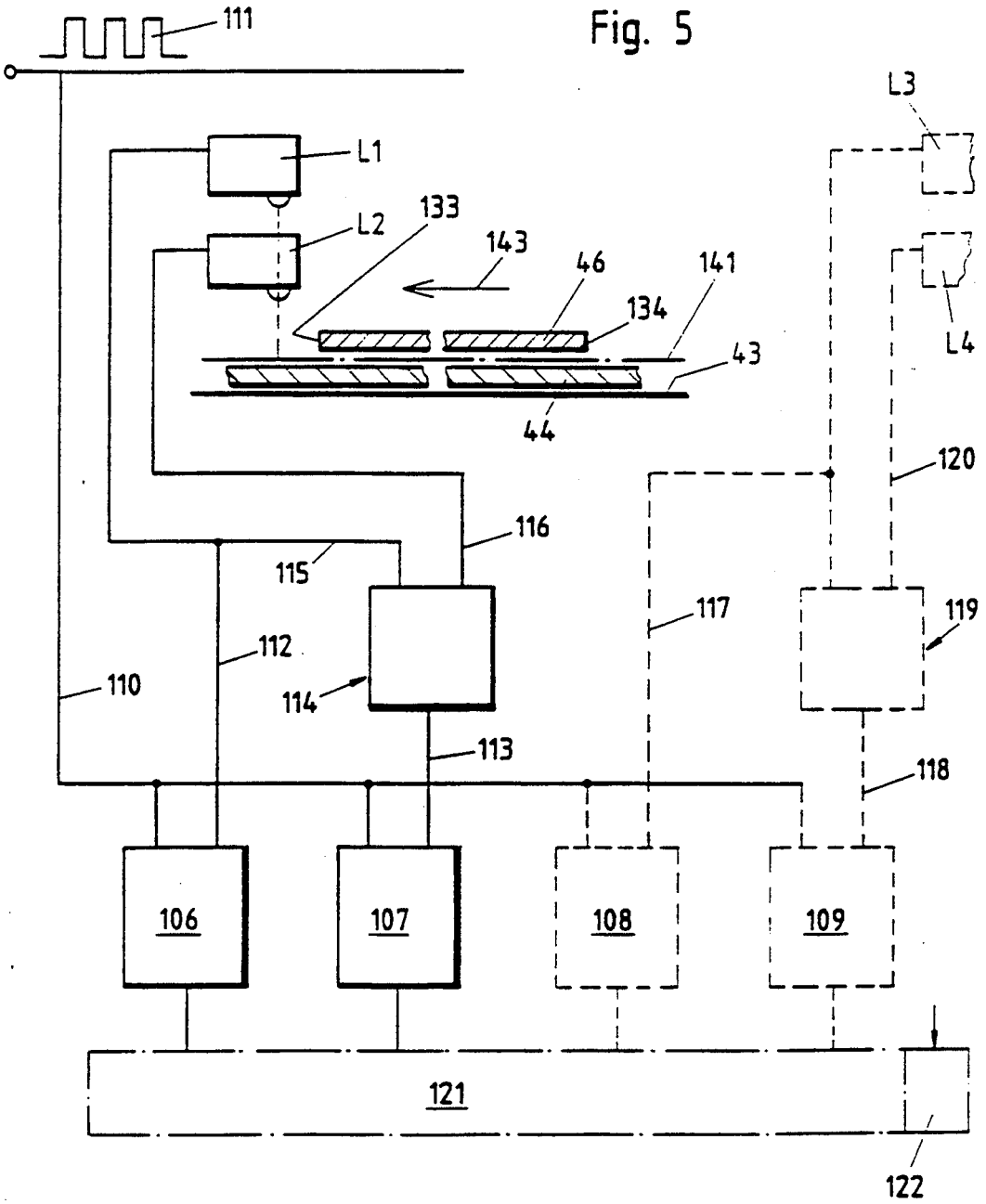
FIG. 5 is a diagrammatic view showing information processing stages, including alternative features for Embodiments 1 and 2.

Referring now to FIG. 5, within the control 23 there are provided counters 106, 107, 108 and 109 which are connected to a line 110. The line 110 conducts the pulses 111 fed to the drive motor 54. The counter 106 is connected via a line 112 to the light barrier L1. Furthermore, the counter 107 is connected, via a line 113, to an exclusive-OR element 114, which is connected to the light barriers L1 and L2 via lines 115, 116.

Corresponding to the circuit connection described between the light barriers L1 and L2 and the counters 106, 107, the counter 108 is connected via a line 117 to the light barrier L3 and the counter 109 is connected via a line 118 to an exclusive-OR element 119 to which, in turn, the light barrier L4 is connected via a line 120 and the light barrier L3 via the line 117. The outputs of the counters 106 to 109 are connected via unnumbered lines, with a control unit 121 to which the values of design dimensions can be fed via an input device 122. In detail, these are the distances a, b, c, d, and the resolution of the transport device referred to above.

The construction of a pocket insert 123 in which the second sewing-material part 46 is a pocket flap will be described below on the basis of FIGS. 6–9.

Figure 6:
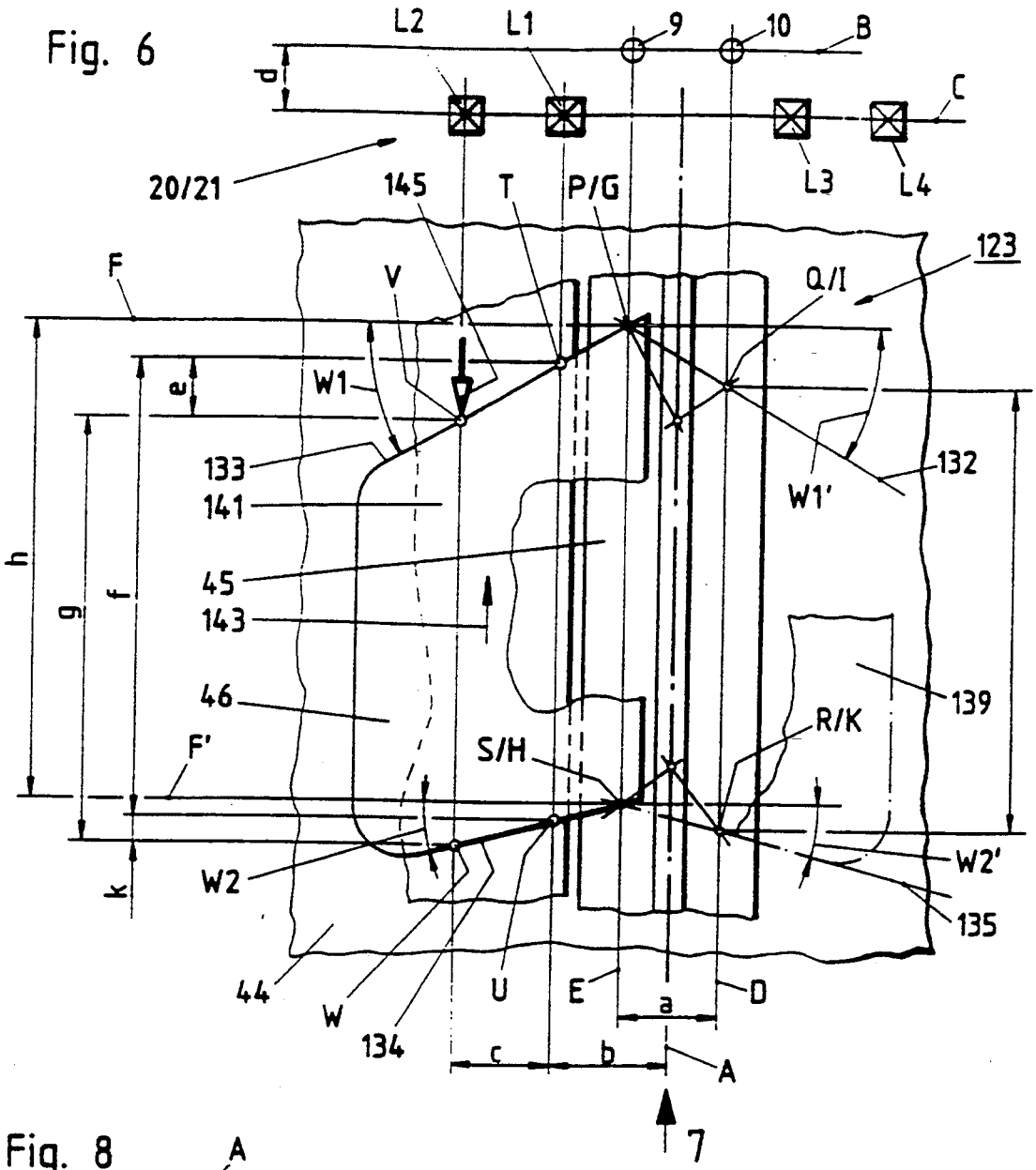
FIG. 6 is a view, seen in the direction indicated by the arrow 2 in FIG. 1, of sewing-material parts lying one on the other, shown on a larger scale.

The parts 44, 45, 46 which lie on one another in accordance with FIG. 6, are sewn together by a seam 124 and a seam 125. The seams 124 and 125 extend on axes D and E. These axes are parallel to the axis A and intersect the center lines of the needles 9, 10. The seams 124 and 125 are limited in their length by limitation points G, H, and I, K (FIG. 8).

Regardless of the sequence in which different cuts are made in the first sewing-material part 44 and the piping strip 45, the corner cuts 126 and 127 are produced as follows. The corner cut 126 is provided with arms 128, 129 extending to form a V-shape with each other and having end points P and Q. In corresponding manner, the corner cut 127 is provided with arms 130, 131 which extend to form a V-shape with each other and have end points R and S. As can be noted from FIG. 6, a line connecting (not numbered) the end points P, Q and a line connecting (not numbered) the delimiting points G, I coincide to define a line 132. From the point P/G formed thereby there extends one edge 133 of the second sewing-material part 46. An axis F extending through the point P/G parallel to the axis C forms an angle W1 with the edge 133. The line 132 extending through the point P/G is a mirror image of the edge 133 with respect to the axis A, so the line 132 forms an angle W1′ with the axis F, the value of which corresponds to that of W1.

The same geometrical conditions are present at an edge 134 of the second sewing-material part 46 which forms an angle W2 with an axis F′ extending parallel to the axis C. Corresponding to the point P/G, there is formed a point S/H from which a line 135 extends. It forms with the axis F′ an angle W2′ which is equal in value to the angle W2.

Figure 8:
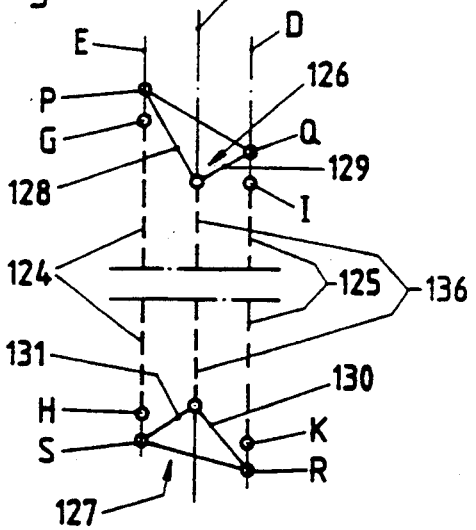
FIG. 8 shows the cuts and seams to be produced in the workpiece shown in FIG. 6, in a shortened view.

(Solely for easier understanding, in FIG. 8 the end points P, Q, R and S are shown as being spaced away from the limiting points G, H, I and K.)

The pocket insert 123 is provided with a longitudinal cut 136 in the first sewing-material part 44 and the piping strip 45, said cut ending in vertex points (not numbered) in which the arms 128, 129 and 130, 131 of the corner cuts 126 and 127 come together. The longitudinal cut 136 is shown diagrammatically in FIG. 8 as a dashed line.

After production of the cuts 136, 126, 127 and the seams 124, 125, a pocket insert 137 of an article of clothing 138 is obtained by pulling the piping strip 45 through the slot 136 below the first sewing-material part 44 which is shown in FIG. 6. At the same time, the flap, which here is the second sewing-material part 46, is turned over, finally assuming the position 139 shown in dot-dash line.

In the event that the drive motor 54 is developed as a DC motor operated in a closed control circuit, with position information being reported via a rotary position transmitter 148 attached to the motor, corresponding pulses for distance measurements can also be derived therefrom.

The manner of operation of the sewing system 1 is described as follows:

In the starting position of the sewing system 1, the clamping plates 41, 42 are positioned in their free position 49 and in the preparation station 50; the needle bars 7, 8 of the twin-needle sewing machine 3 are stopped in their upper dead end positions; the cutting device 11 has brought the corresponding bar 12 with the knife 13 into its position of rest; and in the corner cutting device 62, the cutting knives 80, 95 are in their lower positions and the displaceable corner knife 70 assumes the end position 72 located nearest the needles 9, 10.

In this position, the control 23 has brought the different drives 16, 54, 93, as well as the servomotors 77 and 96, to a stop in defined positions of rotation.

It is further provided that the light barriers L1 to L4 assume a 1-state upon detection of the second sewing-material part 46 and an 0-state upon reflection of light.

In the starting position, the light barriers L1 to L4 are in each case in their 0-state. Furthermore, the counters 106 to 109 are in reset state, so that their reading is zero.

Starting therefrom, the first sewing-material part 44 is first of all placed on the top side 43 of the work plate 2 and aligned in accordance with sighting marks. Thereupon, the piping strip 45 is placed in a defined position thereon. Finally, in accordance with FIG. 7, the second sewing-material part 46 is placed on one side of the piping strip 45, for which additional alignment marks are provided.

In this connection, the second sewing-material part 46 is placed with a part 140 on a support sheet 141. The surface 142 of the support sheet 141 which faces the part 140 is of such a nature that light is reflected.

After the above-described loading of the sewing system 1, the clamping plates 41, 42 are lowered into their clamping position 48 upon command of the operator, for which purpose the control 23 gives off a corresponding command to the distributor box 101 so that the pneumatic unit 103 causes a corresponding actuation of the pneumatic cylinder 35. As a result of the action of the pneumatic cylinder 35 via the bar 34, the clamping plates 41, 42 are lowered. The clamping plate 41 clamps the first sewing-material part 44, the part of the piping strip 45 present thereon, and the part of the second sewing-material part 46 present thereon. The clamping plate 42 clamps the first sewing-material part 44 and the part of the piping strip 45 present thereon. This condition is shown diagrammatically in FIG. 7, in which the clamping plates 41 and 42 have intentionally been placed for better viewing with a clearance above the second sewing-material part 46 and the piping strip 45.

After a further command is given, the workpiece 47 which includes the first sewing-material part 44, the piping strip 45, and the second sewing-material part 46 is transported in the direction indicated by the arrow 143 to the sewing position 51. This transport movement is effected on the polished top side 43 of the work plate 2 without relative displacement of the different parts 44, 45, 46 with respect to each other. For carrying out the transport movement, the control 23, via the electric unit 102, controls the drive motor 54 in a predetermined manner, and the motor drive is transmitted via the toothed belt 56 (its upper course 58) to the carriage 30.

The pulses fed to the drive motor 54 are proportional to the path moved over by the clamping plates 41, 42, and therefore to the transport path moved over by the workpiece 47.

During the transport movement of the clamping plates 41 and 42 to the sewing position 51, the light barriers L1 and L2 of the sensor device 20 are actuated, one after the other, by the second sewing-material part 46 which is moved past them. In this connection, the light barrier L1 detects the leading edge 133 of the second sewing-material part 46, whereby the light barrier L1 changes from its 0-state into its 1-state. The geometrical locus of the detection of the leading edge 133 by the light barrier L1 represents a measurement point T. Upon the further transport of the workpiece 47, the light barrier L1 experiences a further change in its state as soon as it has detected the trailing edge 134 of the second sewing-material part 46. The geometrical locus of the detection of the trailing edge 134 by the light barrier L1 represents a measurement point U. Just at the edges 133 and 134 of the second sewing-material part 46 were detected by the light barrier L1, those edges 133 and 134 are also detected by the light barrier L2 at a different position, the geometrical loci of the detection of the edges 133 and 134 by the light barrier L2 forming the measurement points V, W. With the workpiece 47 described, no changes in state occur at the light barriers L3, L4. Accordingly, those light barriers L3 and L4 are not taken into consideration below.

The changes in state of the light barriers L1 and L2 cause, within the control 23, various counting and computing processes which will be explained below in connection with FIG. 5. Based on the arrangement of the light barriers L1 and L2 on the axis C, the light barriers L1 and L2 have been shown diagrammatically one above the other in FIG. 5.

As soon as the light barrier L1 has detected the measurement point T, it assumes the 1-state, which causes the counter 106 to count the pulses 111 given off by the control 23 to the drive motor 54 from that time on. Because the light barriers L1 and L2 are connected with the exclusive-OR element 114, the counter 107 begins to count the pulses 111 as soon as one and only one of the light barriers L1 or L2 has assumed its 1-state. Thus, the distance e extending parallel to the axis A is detected.

After the completion of the second counting process, a calculation of the angle W1 for the edge 133 is effected in the control unit 121 by means of the design dimensions that have been introduced (discussed above) and the distance e. This calculation is effected according to formulas which are stored in the control unit 121. After the measurement value required for the calculation of the angle W1 has been given to the control unit 121, the counter 107 is reset to the reading 0.

Thereupon the angle W1 is converted into a signal corresponding to the angle W1' in the form of a train of pulses, in the control unit 121, said train being then provided to the servomotor 96 of the corresponding corner knife 70. By this process, the corner knife 70 is set in its angular position corresponding to the angle W1'.

At the same time as the calculation of the angle W1' and the generation of the signal in the form of a train of pulses for the displacement of the corner knife 70, after detection of the edge 133 by the light barriers L1 and L2, the control unit 121 calculates the residual distance still to be moved over until the needle 9 is above the point P/G and, accordingly, the needle 10 is above the point Q/I, on the basis of further formulas which are stored therein. The needle bars 7, 8 are engaged so that the production of the seam 124 and of the seam 125 which are defined by the reference points G and I commences at the points P/G and Q/I.

From the geometrical conditions detected and calculated above, the exact time for the engagement of the cutting device 11 which produces the longitudinal cut 136 is furthermore calculated in the control unit 121. Finally, the edge 134 is detected by the light barrier L1 at the measurement point U. In this way, the light barrier L1 again assumes its 0-state, whereby the counting process in the counter 106 is terminated. The number of pulses 111 counted by the counter 106 is proportional to the distance f limited by the measurement points T and U, which distance the control 23 can thus calculate.

When the edge 134 is detected by the light barrier L1, a new counting process is furthermore commenced at the counter 107 until the edge 134 has also been detected by the light barrier L2. Thereupon a corresponding measurement value is entered into the control. With the pulses 111 counted in the counter 107, the control 23 is able now to calculate the distance k. Thereupon the angle W2 is calculated. The conversion into a signal corresponding to the angle W2' for the displacement of the corner knife 69 associated with the edge 134 then takes place in the control 23. By this process the corner knife 69 is set in its angular position corresponding to the angle W2'.

With this information, the control 23 is furthermore able to calculate the distance g and thus the distance h as the length of the seam 124 and the distance i as the length of the seam 125, by means of further formulas. Thus, information concerning the positions of the limiting points H and K terminating the seams 124, 125 is also available to the control 23. Accordingly, the control 23 causes a precise termination of the seams 124, 125, including a thread-cutting process, for which the needle bars 7, 8 are correspondingly disengaged one after the other. In accordance with the description given above, the limiting points G, H, I and K of the seams 124, 125 are now positioned in accordance with the detected measurement values.

Furthermore, the control 23 causes an exactly positioned disengagement of the cutting device 11, so that the longitudinal cut 136 is introduced into the parts 44 and 45 in defined manner on the basis of the measurement values.

In the meantime, the control 23 has, on basis of the measurement values given off by the light barriers L1, L2, caused a corresponding displacement of the movable corner knife 70 in the direction indicated by the arrow 143, by actuating the drive motor 93.

After the workpiece 47 has been transported further through the sewing position 51, it is finally positioned in the cutting position 52.

In this position, the knife drives 82 and 97 of the corner knives 69 and 70 are acted on by compressed air so that their cutting knives 80 and 95 pass through the first sewing-material part 44 and the piping strip 45. The cutting knives 80 and 95 are in this connection moved into their upper position 144, as shown in dash-dot line in the case of the cutting knife 95 in FIG. 1.

The unequally long cuts of the arms 130, 131 and 128, 129 are made in known manner in accordance with the aforementioned U.S. Pat. No. 3,820,481 as a function of the corresponding angular position of the corner knife.

After the corner cuts 127 and 126 have been made and the cutting knives 80, 95 have been moved back, the clamping plates 41, 42 are lifted by a corresponding actuation of the pneumatic cylinder 35 so that the workpiece 47 can be removed. After a command has been given, the control 23 causes the clamping plates 41, 42 to move back from the cutting position 52 via the sewing position 51 into the preparation station 50, and the sewing system 1 is returned to its starting position described above.

For operation with the sewing system 1, it is particularly advantageous for the sensor device 20 to have light barriers L1, L2, L3, L4 on both sides of the axis A. This makes it possible to alternatively work the second sewing-material part 46 on one side or the other of the axis A, without requiring resetting work. Therefore, the edges 133, 134 of the second sewing-material part 46 can be detected alternatively by the light barriers L1, L2 or the light barriers L3, L4.

A modified form of Embodiment 1 can be produced with the use of only the sensor device 21, which has merely the light barriers L1 and L2. Accordingly, the components shown in dashed lines in FIG. 5 are eliminated, thus resulting in lower manufacturing costs.

A simplified form of Embodiment 1 has merely a single light barrier, for instance merely the light barrier L1. It serves for the optical detection of the edges 133, 134 in the manner described, i.e. the measurement points T and U are detected without contact. In contradistinction to-the embodiments described above, the measurement point V is detected here by providing an arrow-shaped rest mark 145, at a fixed point on the support sheet 141. The distance of the rest mark 145 from the axis B in this case also belong to the design dimensions to be introduced into the control unit by the operator.

Figure 9:
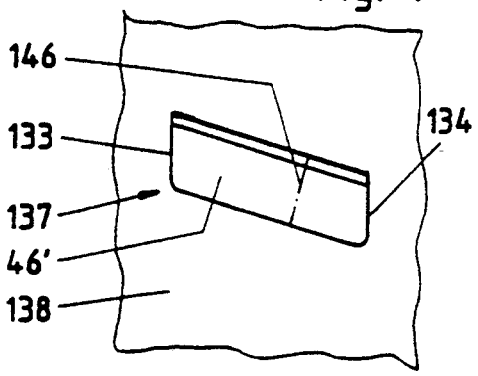
FIG. 9 shows a part of an article of clothing which is provided with an obliquely extending pocket insert, including an obliquely formed flap.

Upon the insertion of the workpiece, this rest mark 145 serves for positioning the second sewing-material part 46. In this connection, the manufacturing deviations with respect to the angles W1 and W2 are accepted as being sufficiently accurate. The sewing system 1 which is developed in this simplified manner permits automatic angular adjustment of the corner knives 69, 70 when the control 23 is provided with additional information. For this purpose, a preselection is made with respect to the shape of the second sewing-material part 46 to be worked and a corresponding input us fed via the operating element 24 to the control 23. Examples of such a preselection are:

a) A shape is selected in connection with which the angles W1 and W2 are of the same size. An example of such a shape is the case of the pocket insert 137 (FIG. 9).

b) A shape is selected in connection with which one of the angles W1 or W2 has the value zero. An example of this alternative is an edge 146 which is shown on the second sewing-material part 46' in FIG. 9.

Under the conditions described, it is possible, in example (a), to bring about automatic angle setting of the two corner knives 69, 70 and, in example (b), automatic angle setting of only one corner knife 69 or 70, which is associated with the edge detected.

Even with this simplified form of Embodiment 1, automatic setting of the corner knife 70 with respect to the length of the second sewing-material part 46 is possible.

Embodiment 2

In contradistinction to Embodiment 1, in which the detection of the edges 133, 134 takes place during relative movement between the sensor device 20 or 21 and the second sewing-material part 46, by sensors at defined measurement points, in the case of Embodiment 2 the edges 133, 135 are detected at a standstill and therefore without said relative movement. For this purpose, instead of the sensor device 20 or 21, a camera 147 is fastened on the head 6 of the twin-needle sewing machine 3 via a support arm, not designated by number, and serves as an angle and length detection device. The camera 147 is connected via an appropriate circuit with the control 23 for the transmission of measurement variables. In this Embodiment, the structural parts provided for the light barriers L1 to L4 are absent. Otherwise, the sewing system of this Embodiment 2 corresponds to that of Embodiment 1.

The manner of operation of the sewing system of Embodiment 2 is as follows:

The angles W1 and W2 of the edges 133 and 134 and the length of the second sewing-material part 46 are measured in the preparation station 50. Thereupon corresponding measurement values are delivered to the control 23, which carries out the further operation of the machine in the manner described with respect to Embodiment 1.

In either of the embodiments described, the invention can also be carried out by replacing the disclosed corner knives 69, 70, which permit a quasi-stepless angle setting, with the less expensive corner knives (cutting device) described in the aforementioned U.S. Pat. No. 3,820,481. They are characterized by a purely pneumatic angle setting, whereby several structurally established angle positions can be reached. In this case, a selection from the available angle positions is effected in the control as a function of the angles W1 and W2 detected.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for the production of a pocket insert with the use of a sewing system, comprising the following steps:

positioning an intermediate sewing-material part on a first sewing-material part in a preparation station, and positioning a second sewing-material part on the intermediate sewing-material part;

transporting the sewing-material parts jointly into a sewing position and sewing them together with seams which extend parallel to a first axis (A), the seams having limiting points (G,H; I,K), and the second sewing-material part having edges extending at angles (W1; W2) to the first axis (A), making a longitudinal cut extending between the seams in the first sewing-material part and in the intermediate sewing-material part;

transporting the sewing-material parts into a cutting position in which corner cuts with variable angular positions are carried out in the first sewing-material part and in the intermediate sewing-material part, the corner cuts having end points (P,Q; R,S);

before making the corner cuts, detecting at least one of the edges of the second sewing-material part with a sensor device which is connected with a control unit;

after detection of the at least one edge, providing an angle measurement signal representative of a measurement value from the sensor device to the control unit, and calculating at least one angle in response to said at least one edge of the second sewing-material part on the basis of said angle measurement signal;

providing a setting member for the corner knife with a control signal from the control unit corresponding to the at least one detected edge of the second sewing-material part; and turning the corner knife in response to the control signal until the end points (P, Q; R, S) of the corner cut define a line extending parallel to a line defined by the limiting points (G,I; H,K) of the seams.

2. A method according to claim 1, characterized by the fact that two measurement points (T,V; U,W) which detect the at least one edge are defined at unequal distances to the first axis (A).

3. A method according to claim 1, characterized by the fact that the edge of the second sewing-material part is detected by a detection device and said angle measurement signal representative of the measurement value is sent to the control unit in the form of information representing said at least one angle.

4. A method according to claim 1, characterized by the fact that the setting members of both corner knives receive control signals from the control unit for displacing both corner knives corresponding to said at least one angle.

5. A method according to claim 1, characterized by the fact that the sensor device detects both edges of the second sewing-material part, and the angles, (W1, W2) in response to detection of each edge of the second sewing-material part, are determined by the control unit; and each setting member is provided by the control unit with a respective control signal for the displacement of the corner knife corresponding to the angle determined.

6. A method according to claim 1, characterized by the fact that the control unit produces an initiating signal to initiate the production of seams in response to said angle measurement signal produced by the sensor device.

7. A sewing system for the production of a pocket insert, comprising:

a twin-needle sewing machine with a drive for producing seams extending parallel to a first axis (A) in a first sewing-material part, an intermediate sewing-material part positioned thereon, and a second sewing-material part which is positioned on said intermediate sewing-material part and which has a first edge and a second edge, each extending at a respective angle (W1, W2) to said first axis (A);

a transport device with a drive for transporting the sewing-material parts;

a knife for producing a longitudinal cut at least in the first sewing-material part and between the seams;

a cutting device, including a drive and corner knives, for producing corner cuts at least in the first sewing-material part, said corner cuts being provided with arms having end points (P, O, R, S), and a control for controlling the drives of the twin-needle sewing machine, the transport device, and the cutting device, and for providing the corner knives with variable angle positions for the production of the corner cuts;

a sensor device disposed for detecting at least one of the edges of the second sewing-material part and for sending a sensor signal representative of a measurement value to the control; said control having a control part for converting said sensor signal into an angle measurement signal representative of said variable angle positions.

8. A sewing system according to claim 7, comprising at least two devices disposed for the detection of measurement points (T, V, U) of an edge of the second sewing-material part, the two devices being arranged at unequal distances from said first axis (A).

9. A sewing system according to claim 8, characterized by the fact that the devices are arranged on an axis (C) which extends at a right angle to said first axis (A).

10. A sewing system according to claim 8, characterized by the fact that the devices include light barriers for detecting respective measurement points (T, V, U, W) of the edges of the second sewing-material part.

11. A sewing system according to claim 10, characterized by the fact that the sensor device includes two light barriers on each side of said first axis (A).

12. A sewing system according to claim 10, characterized by the fact that the light barriers are arranged on an axis (C) which extends at a right angle to said first axis (A).

13. A sewing system according to claim 12, characterized by the fact that the sensor device includes two light barriers on each side of said first axis (A).

14. A sewing system according to claim 7, characterized by the fact that the sensor device includes an angle-detection device.

15. A sewing system according to claim 14, characterized by the fact that the sensor device includes a camera.

16. A sewing system according to claim 7, characterized by the fact that the sensor device is operable for detection of a distance extending between the edges of the second sewing-material part parallel to said first axis (A).

17. A sewing system according to claim 8, characterized by the fact that the sensor device is operable for detection of a distance extending between the edges of the second sewing-material part parallel to said first axis (A).

18. A sewing system according to claim 10, characterized by the fact that the sensor device is operable for detection of a distance extending between the edges of the second sewing-material part parallel to said first axis (A).

19. A sewing system according to claim 12, characterized by the fact that the sensor device is operable for detection of a distance extending between the edges of the second sewing-material part parallel to said first axis (A).

20. A sewing system according to claim 14, characterized by the fact that the sensor device is operable for detection of a distance extending between the edges of the second sewing-material part parallel to said first axis (A).

* * * * *